United States Patent [19]

Peters et al.

[11] Patent Number: 4,840,871

[45] Date of Patent: Jun. 20, 1989

[54] COLOR PHOTOGRAPHIC HEAT DEVELOPMENT PROCESS

[75] Inventors: Manfred Peters, Leverkusen; Hans Öhlschläger, Bergisch-Gladbach; Thomas Kaluschke, Leichlingen; Kaspar Wingender, Leverkusen; Günther Schenk, Cologne; Immo Boie, Leichlingen, all of Fed. Rep. of Germany

[73] Assignee: AGFA-Gevaert Aktiengessellschaft, Leverkusen, Fed. Rep. of Germany

[21] Appl. No.: 201,840

[22] Filed: Jun. 3, 1988

[30] Foreign Application Priority Data

Jun. 13, 1987 [DE] Fed. Rep. of Germany ..... 3719880

[51] Int. Cl.[4] ..... G03C 5/54; G03C 1/34

[52] U.S. Cl. ..... 430/203; 430/611; 430/617

[58] Field of Search ..... 430/203, 617, 611

[56] References Cited

U.S. PATENT DOCUMENTS 4,713,319 12/1987 Aono et al. ..... 430/203

4,761,361 8/1988 Ozaki et al. ..... 430/203

*Primary Examiner*—Richard L. Schilling

*Attorney, Agent, or Firm*—Connolly & Hutz

[57] ABSTRACT

Process for the production of color images by the color photographic dye diffusion process in which development is brought about by heat and water. The combination of antifoggants added to the light-sensitive material, in particular the combination of compounds of formulae I and II, produces a marked improvement in storage stability and constancy of sensitivity with good $D_{min}/D_{max}$ ratios.

(I)

$R^1$ denotes hydrogen, alkyl with up to 6 carbon atoms, hydroxy, halogen, alkoxy or substituents which together form a condensed benzene ring, and in formula II below:

(II)

$R^2$ denotes a group which can be split off in the process of development of the material and $R^3$ denotes hydrogen, halogen, alkyl with up to 4 carbon atoms, alkoxy, carboxy, carbalkoxy, carbonamido or sulphonamido.

4 Claims, No Drawings

COLOR PHOTOGRAPHIC HEAT DEVELOPMENT PROCESS

This invention relates to a process for the production of colour images by the dye diffusion process in which development is brought about by heat in the presence of water. Development is activated by a base donor incorporated in the mordanting sheet. The material contains additives in the form of combinations of substances which improve the sensitometry and storage stability of the light-sensitive element.

It is known that colour images may be produced by heat treatment of suitable colour photographic recording materials. Particularly suitable colour providing compounds for this purpose are those which can be incorporated in a non-diffusible form in the layer of a photographic recording material and are capable of releasing a diffusible dye as a consequence of this development (dye releasing compounds).

The special suitability of such dye releasing compounds is based on the fact that the dyes which are released imagewise can be transferred to separate image receptor layers where they form a brilliant colour image which has no superimposed image silver or silver halide and therefore requires no after-treatment. The combination of heat development and dye diffusion thus provides an advantageous rapid process for the production of colour images. A suitable recording material for this purpose is described, for example, in DE-A-3 215 485.

According to the above-mentioned publication, a recording material having a layer which contains a combination of silver halide, silver benzotriazole, a dye releasing compound and guanidine trichloroacetate (base donor) is exposed imagewise and then subjected to a heat treatment in contact with an image receptor sheet so that the dye which has been released imagewise is transferred to the image receptor sheet. The production of multicolour images requires several such combinations in each of which the silver halide is sensitive to a different spectral region of light and according to its spectral sensitivity it is associated with a dye releasing compound which releases a dye of a different colour, in most cases a colour which is complementary to the colour of the light to which the particular silver halide is predominantly sensitive. Such associations may be arranged one above another in different layers.

The development and especially the diffusion of released dyes requires alkaline conditions which may be obtained, for example, from the decomposition of the above-mentioned base donor as a result of the heat treatment. If, on the other hand, alkaline conditions are established prematurely, e.g. if the base donor is insufficiently stable or if a free base is present in the recording material, then the recording material is not sufficiently stable and it is difficult to obtain sufficient density differences between regions of high and low exposure, especially if the recording material is stored for some time before use.

Numerous chemical compounds have already been proposed as base donors, e.g. in DE-A-3 529 930, DE-A-3 529 934, DE-A-3 530 053, DE-A-3 530 063, DE-A-3 530 201, DE-A-3 530 213 and DE-A-3 530 214, but none of these has provided entirely satisfactory results.

It is also already known (e.g. from EP-A-0 121 765) that the transfer of an imagewise distribution of mobile dyes from an originally light-sensitive layer to an image receptor layer may be brought about by a heat treatment in the presence of water, for example when an image receptor sheet which has been moistened with water is heated in contact with a sheet which has already been developed and contains the mobile dyes. The base required for the dye diffusion is then present in the originally light-sensitive sheet in which it was previously released from a base precursor compound by the heat treatment of the development process in the absence of water. This procedure has, of course, all the disadvantages of those processes in which the thermolabile base donors are present in close contact with the light-sensitive layers and the base is released from these donors by the heat treatment of the development process.

One possibility of avoiding these problems lies in preventing premature contact of the light-sensitive element with the base compound or the base precursor. This is achieved by incorporating the base or the base precursor compound in a light-insensitive element which is stored separately from the light-sensitive element and is only brought into contact with the latter when development takes place. Thus, for example, the base donor may be incorporated in an image receptor element which is applied to a separate support not in contact with the light-sensitive element. The image receptor element in that case fulfils a double function. Firstly, it provides the base for activating the development process and secondly it functions as mordant for fixing the dye which has been released imagewise. The base donors in the image receptor sheet may be guanidinium salts such as guanidinium carbonate. This method, however, requires measures which demand both an improvement in the sensitometry and storage properties and stabilization of the light-sensitive element!

Antifoggants, stabilizers and stabilizer precursor compounds are in the main compounds containing sulphur and nitrogen. Their use in silver halide materials has been amply described in prior publications; see a comprehensive report in Research Disclosure (1976), No. 15162, pages 75 to 87, as well as in T. H. James, The Theory of the Photographic Process, 4th Edition, Macmillan, 1977, pages 396–399. Examples of the use of stabilizers in a dye diffusion material which can be developed by heat are given in DE-A-3 345 023, which describes compounds with a phenylmercaptan structure which reduce fogging. DE-A-3 526 315 describes a wide range of typical antifoggants and stabilizers in their special function as resolution retarders for a light-insensitive silver salt in a silver halide/dye diffusion system which is developable by heat. The good $D_{min}/D_{max}$ ratios and storage properties are particularly mentioned as advantageous effects obtained. Stabilizer precursors from which the stabilizers are released and become active only when the photographic process is carried out are mentioned in U.S. Pat. No. 4,639,408 and EP-A-187 343. The improvement mentioned in these documents is the high constancy of processing. Numerous typical compounds which reduce fogging are described in U.S. Pat. No. 4,619,883 as additives for the layer of an image receptor element of a heat developable dye diffusion material.

When known antifoggants and stabilizer compounds were used, however, it was found that the desired effect of good $D_{min}/D_{max}$ ratios and high stability after storage was not achieved in the present photographic reproduction process. For this process, improvements were still necessary.

It is an object of the present invention to provide a process for the preparation of a dye diffusion material which can be processed by a simple method.

The images which can be developed by heat and by addition of water should be distinguished by high storage stability in the sense that they undergo little change in the $D_{min}/D_{max}$ ratio and the sensitivity.

The present invention relates to a process for the production of colour images by the photographic dye diffusion process in which a first sheet material comprising a layer support carrying at least one light-sensitive silver halide emulsion layer and at least one non-diffusible colour providing compound which is capable of being decomposed imagewise in the process of development to release a diffusible dye and/or a second sheet material which is insensitive to light and contains a salt of a strong organic base and a weak acid is or are moistened with an aqueous liquid and the two sheet materials are heated to 50° to 100° C. with their coated sides in contact and are subsequently separated. The first sheet material, which is light-sensitive, contains a combination of compounds of the following formulae I and II:

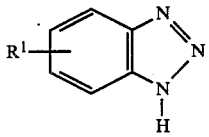

(I)

wherein $R^1$ denotes hydrogen, alkyl with up to 6 carbon atoms, hydroxy, halogen, alkoxy or substituents which together form a condensed benzene ring,

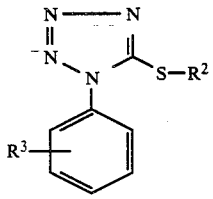

(II)

wherein $R^2$ denotes a group which can be split off in the process of development of the material and $R^3$ denotes hydrogen, halogen, alkyl with up to 4 carbon atoms, alkoxy, carboxy, carbalkoxy, carbonamido or sulphonamido.

Especially advantageous results are obtained when the first, light-sensitive sheet material in addition contains at least one compound corresponding to one of the following formulae III and IV:

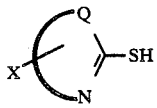

(III)

wherein

Q denotes the group required for completing a heterocyclic group containing a 5- or 6-membered heterocyclic ring and X denotes a carboxylic or sulphonic acid group or a group containing a carboxylic or sulphonic acid group.

The heterocyclic ring of formula III which is completed by Q may be an oxazole, thiazole, selenazole, imidazole, triazole, oxadiazole, thiadiazole, tetrazole, pyridine, pyrimidine, oxazine, thiazine or triazole ring.

The heterocyclic rings may in turn be substituted, e.g. with alkyl, aryl, aralkyl, hydroxy, alkoxy, halogen, substituted amino or sulphonamide groups or they may consist of benzo or naphtho groups.

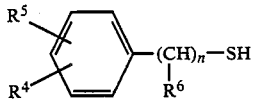

(IV)

wherein $R^4$ denotes hydrogen, alkyl with up to 18 carbon atoms, alkoxy or halogen, $R^5$ denotes hydrogen or an alkyl group with up to 18 carbon atoms, $R^6$ denotes hydrogen or an alkyl group with up to 3 carbon atoms, and n represents 0, 1 or 2.

The light-insensitive sheet material may contain a mordant for fixing the dye which has been released imagewise.

The strong organic bases required for the dye diffusion process may be added to the light-insensitive sheet material in the form of guanidinium salts.

Specific examples of effective compounds according to the invention are given below, compounds corresponding to formulae I carrying the reference NH, those of formulae II the reference STP and those of formulae III and IV the reference SH.

NH-1

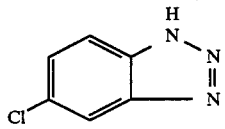

NH-2

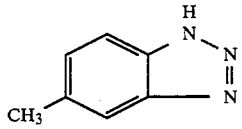

NH-3

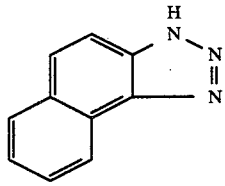

NH-4

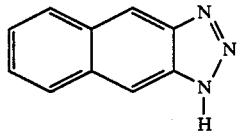

NH-5

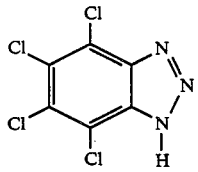

-continued
NH-6
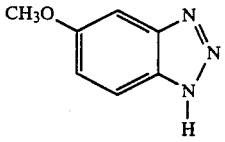
STP-1
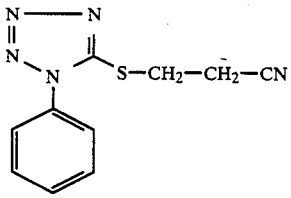
STP-2
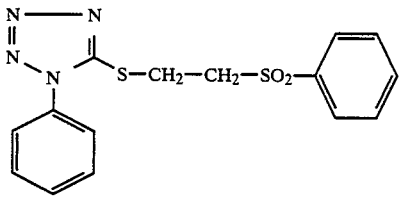
STP-3
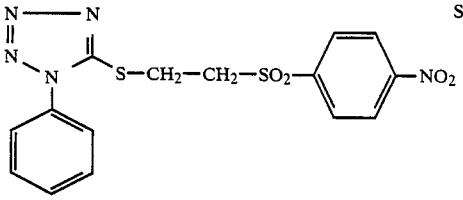
STP-4
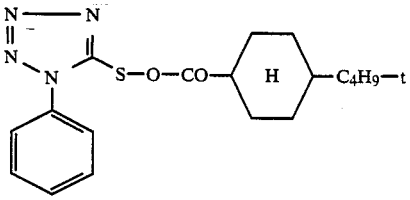
STP-5
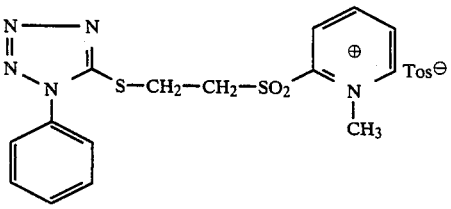
STP-6
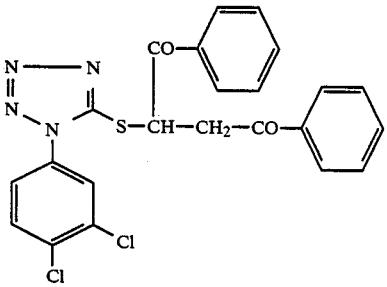
-continued
STP-7
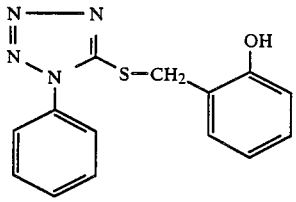
STP-8
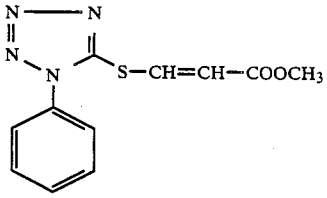
SH-1
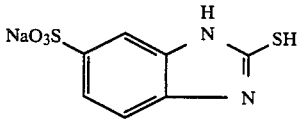
SH-2
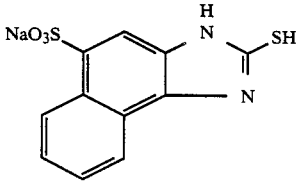
SH-3
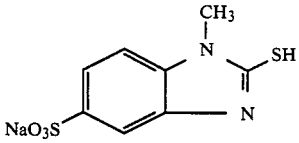
SH-4
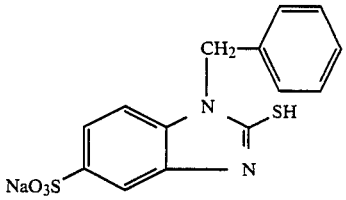
SH-5
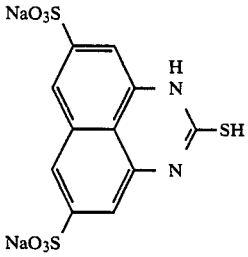
SH-6
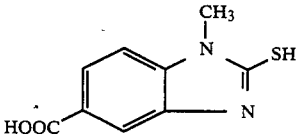
SH-7
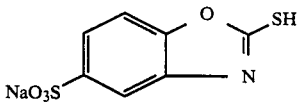

-continued

SH-8

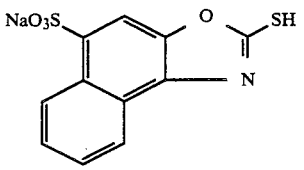

SH-9

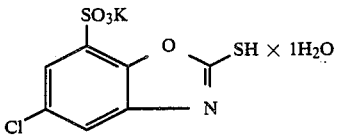

SH-10

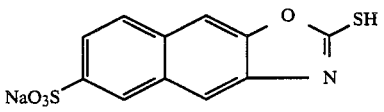

SH-11

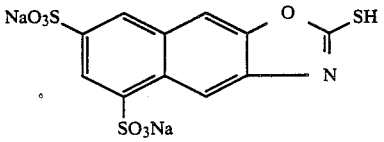

SH-12

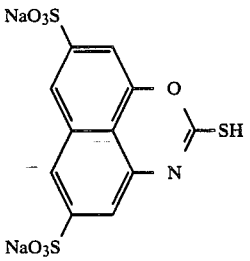

SH-13

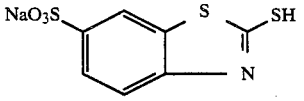

SH-14

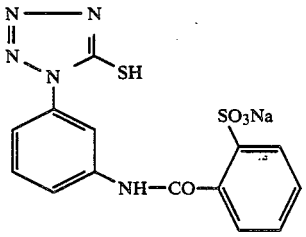

SH-15

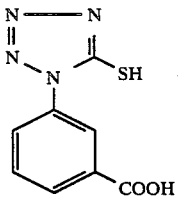

-continued

SH-16

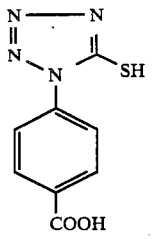

SH-17

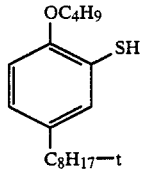

SH-18

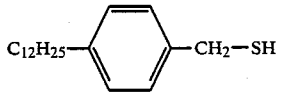

The process according to the invention requires a light-insensitive sheet material containing at least one layer of binder which is mounted on a transparent or opaque layer support and has a salt of a weak inorganic acid and a strong organic base dispersed therein. This light-insensitive sheet material serves as processing auxiliary sheet and if necessary also as image receptor material. The light-sensitive sheet material which has been exposed imagewise is brought with its coated surface into contact with the coated side of the light-insensitive sheet material after at least one of the two sheet materials has been sufficiently moistened with an aqueous liquid. The resulting laminate is heated to 50°–100° C. and then separated after a contact time which is sufficient for development and dye diffusion, e.g. after 5 to 200 seconds.

Examples of strong organic bases which are suitable for the process according to the invention and can be used in the form of their salts with weak organic acids include amidines and derivatives of guanidine and their vinylogous compounds. Many of these compounds may be described by the following formula (V):

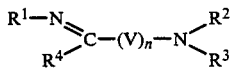

(V)

wherein $R^1$, $R^2$ and $R^3$ denote H or alkyl, $R^4$ denotes H, alkyl, aryl, an amino group

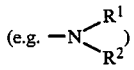

or a guanidine group or $R^1$ together with $R^2$ denotes an alkylene group with 2, 3 or 4 carbon atoms and/or $R^3$ together with $R^4$ denotes an alkylene group with 3, 4 or 5 carbon atoms, a vinylene group, a divinylene group (e.g. —CH=CH—CH=CH—) or a group of the formula:

$$-(CH_2)_p-C\overset{N-R^1}{\leftarrow}\ ,$$

wherein $R^1$ has the meaning indicated above and p stands for 2, 3 or 4;

V denotes a vinylene group, in particular —CH=CH—, and n stands for 0 or 1.

A specific example of an aryl group denoted by $R^4$ is the phenyl group, which may be substituted or unsubstituted, the substituents preferably having an electron donor character (e.g. methyl, methoxy or amino).

The alkyl groups optionally denoted by $R^1$, $R^2$, $R^3$ and $R^4$ may be identical or different and straight chained or branched and generally contain up to 12 carbon atoms; they preferably contain 1 to 3 carbon atoms.

Specific examples of suitable bases are shown below but the invention is not limited to these.

B-1 $NH_2-C(=NH)-NH_2$

B-2 $NH_2-C(=NH)-NH-CH_3$

B-3 $NH_2-C(=NH)-NH-O-CH_3$

B-4 $NH_2-C(=NH)-NH-C(=NH)-NH_2$

B-5 $CH_3-C(=NH)-NH_2$

B-6 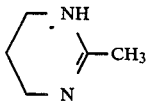

B-7 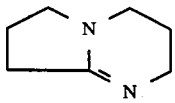

B-8 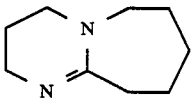

B-9 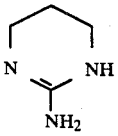

B-10 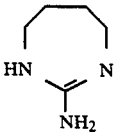

-continued

B-11 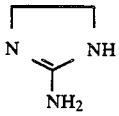

B-12 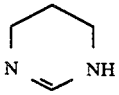

B-13 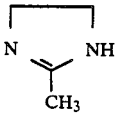

B-14 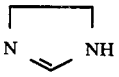

B-15 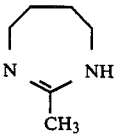

B-16 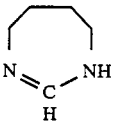

B-17 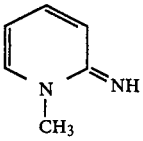

B-18 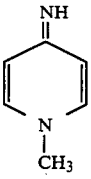

B-19 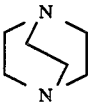

B-20 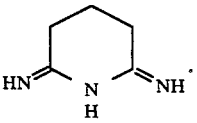

B-21 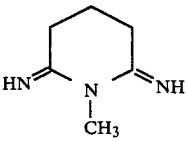

The bases are used as salts of a weak acid. Carbonic acid is a particularly suitable inorganic acid.

Weak acidic organic compounds (hereinafter referred to as acids) are in particular compounds containing one or more of the following groups:

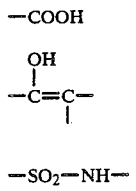

But the weak acidic compounds may also be compounds containing a heterocyclic NH group. They may be present in the form of low molecular weight compounds, preferably with a molecular weight below 400, or as polymers. They preferably correspond to the following formulae VI $$R^5—SO_2—NH—R^6 \quad (VI)$$

wherein $R^5$ denotes an alkyl, aryl or heterocyclic group, either substituted or unsubstituted, and $R^6$ stands for a group such as $R^5$ or hydrogen.

Examples of acids which may be used in the process according to the invention are shown below:

A-1

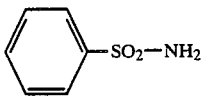

A-2

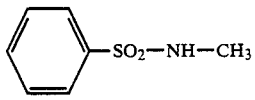

A-3

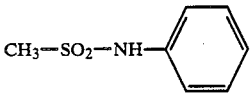

A-4

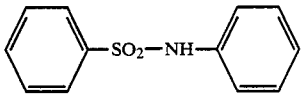

A-5

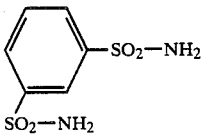

A-6

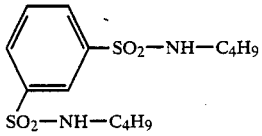

A-7

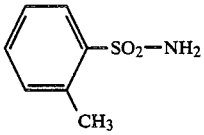

A-8

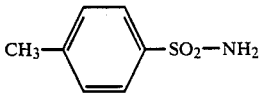

A-9

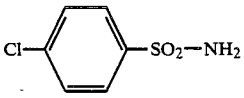

A-10

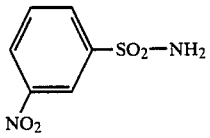

A-11

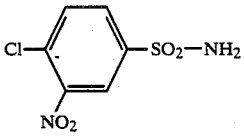

A-12

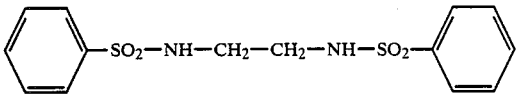

$H_2N—SO_2—CH_2—NH—(CH_2)_6—NH—CH_2—SO_2—NH_2$ A-13

A-14

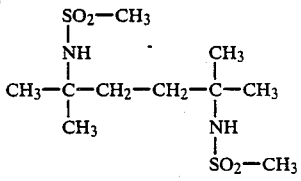

A-15

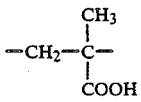

A-16

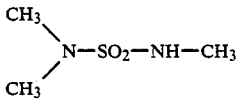

A-17

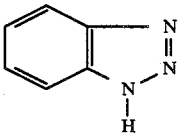

A-18

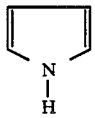

-continued

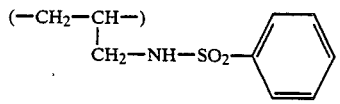

A-19

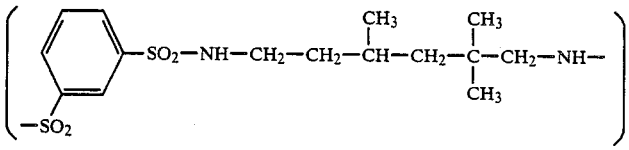

A-20

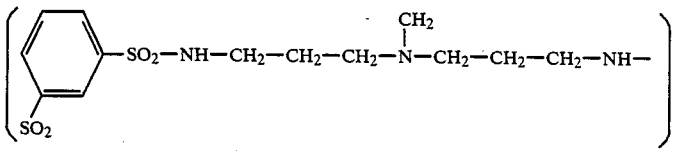

A-21

$H_2CO_3$

A-22

The usual dispersion methods may be used for their incorporation into the layers. The salts of the bases are generally introduced as aqueous solutions into the casting mixtures.

An image receptor layer serves to receive and fix the dyes which are released imagewise in the process of development. It consists substantially of a binder which contains mordant for fixing the diffusible dyes released from the non-diffusible dye releasing compounds. The mordants used for anionic dyes are preferably long chained quaternary ammonium or phosphonium compound, e.g. those described in U.S. Pat. No. 3,271,147 and U.S. Pat. No. 3,271,148.

Certain metal salts and their hydroxides which form sparingly soluble compounds with acid dyes may also be used, or polymeric mordants such as those described in DE-A-2 315 304, DE-A-2 631 521 or DE-A-2 941 818. Polyvinyl imidazole mordants which are partially quaternized, for example with benzyl, hydroxyethyl, alkyl, epoxypropyl, propyl, methyl or ethyl halides are preferred. In these mordants, the degree of quaternization may be from 1 to 50%. The dye mordants are dispersed in one of the conventional hydrophilic binders in the mordant layer, e.g. in gelatine, polyvinyl alcohol, polyvinyl pyrrolidone or partially or completely hydrolysed cellulose esters. Some binders may, of course, also function as mordants, e.g. polymers of nitrogen-containing, optionally quaternary bases, such as N-methyl-4-vinylpyridine, 4-vinylpyridine or 1-vinylimidazole, for example as described in U.S. Pat. No. 2,484,430. Other suitable mordanting binders include, for example, guanylhydrazone derivatives of alkylvinyl ketone polymers as described, for example, in U.S. Pat. No. 2,882,156 or guanylhydrazone derivatives of acyl styrene polymers as described, for example, in DE-A-2 009 498 but the last mentioned mordanting binder would generally be used in combination with other binders, e.g. gelatine.

The colour photographic recording materials used for the process according to the invention have a dimensionally stable layer support which carries at least one layer of binder containing a light-sensitive silver halide, optionally in combination with a substantially light-insensitive silver salt, and a non-diffusible colour producing compound which is capable of releasing a diffusible dye on development.

One essential component of the colour photographic recording material used according to the invention is thus the silver halide which may consist of silver chloride, silver bromide, silver iodide or mixtures thereof and may have a particle size of from 0.02 to 2.0 μm, preferably from 0.1 to 1.0 μm. The silver halide grains may have a regular crystal structure, for example in the form of cubes or octahedrons or they may have an irregular crystal structure or they may be in the form of platelets. In mixed crystals, the silver halides may be uniformly distributed over the whole cross-section of the crystals or their composition may vary in different regions. The silver halide emulsions may also be used in the form of a layered grain structure in which at least two layers differ in their silver halide composition. Negative silver halide emulsions are generally used but direct positive silver halide emulsions may also be used, for example as described in DE-A-2 332 802, DE-A-2 308 239 and DE-A-2 211 728. The light-sensitive emulsion may be present as unsensitized silver halide or it may be chemically and/or spectrally sensitized with suitable additives. If a spectral sensitizer is used, this may be added before, during or after chemical ripening.

The quantity of light-sensitive silver halide in any given layer may vary from 0.01 to 3.0 g per $m^2$, the particular quantity of silver halide used depending on the requirements of the other reactants and the desired effects.

Photographic recording materials which are developable by heat treatment may, as is well known, contain substantially light-insensitive or at least very much less light-sensitive silver salts in addition to the light-sensitive silver halide. Additions of organic silver salts which have approximately the same or a lower solubility than the light-sensitive silver halide are advantageous. Silver salts of organic cyclic imino compounds, for example, are suitable. In preferred examples, the additional silver salts include silver salts of benzotriazole and its derivatives, e.g. alkyl-, hydroxy-, sulpho- or halogen-substituted benzotriazoles. The quantity of organic silver salt compound added may be equimolar to the silver halide compound or greater or less and should be adapted to the particular requirements of the combination of layers.

Another essential component of the light-sensitive recording material used for the process according to the invention is a non-diffusible colour providing compound, This is capable of releasing a diffusible dye as a result of a redox reaction which takes place during development. It will hereinafter be referred to as dye releasing compound.

The dye releasing compounds used in the process according to the invention may belong to any of numerous types of compounds which are all distinguished by containing a connecting member which is redox dependent in the strength of its bond and links a dye residue to a carrier residue which contains a ballast group.

A summarizing report of this subject may be found in Angew. Chem. Int. Ed. Engl. 22 (1983), 191–209, in which the most important of the known systems are described.

Redox active dye releasing compounds corresponding to the formula BALLAST - REDOX - DYE are found to be particularly advantageous. In this formula, BALLAST denotes a ballast residue, REDOX denotes a redox active group, i.e. a group which is oxidizable or reducible under the conditions of alkaline development and which, depending on whether it is present in the oxidized or the reduced state, is capable of undergoing to varying extents an elimination reaction, a nucleophilic displacement reaction, hydrolysis or some other decomposition reaction with the result that the DYE residue is split off, and DYE denotes the residue of a diffusible dye, e.g. a yellow, magenta or cyan dye, or the residue of a dye precursor.

The ballast residues are residues which enable the dye releasing compounds according to the invention to be incorporated in a diffusion-fast form in the hydrophilic colloids conventionally used in photographic materials. Organic residues, generally containing straight chained or branched aliphatic groups with generally 8 to 20 carbon atoms and optionally also carbocyclic or heterocyclic, optionally aromatic groups, are particularly suitable for this purpose. These residues are attached to the remainder of the molecule either directly or indirectly, e.g. through one of the following groups: NHCO, $NHSO_2$, NR (wherein R denotes hydrogen or alkyl), O or S. The ballast residue may in addition contain water-solubilizing groups, e.g. sulpho groups or carboxyl groups which may also be present in an anionic form. Since the diffusion characteristics depend on the molecular size of the whole compound, it is in some cases sufficient to use shorter chained groups as ballast residues, for example if the molecule as a whole is large enough.

Redox active carrier groups having the structure BALLAST-REDOX- and suitable dye releasing compounds are known in a wide variety of forms. A detailed description need not be given here in view of the above-mentioned survey in Angew. Chem. Int. Ed. Engl. 22 (1983), 191–209.

Some examples of redox active carrier groups from which a dye residue is split off as a result of previous imagewise oxidation or reduction are shown below purely for illustration:

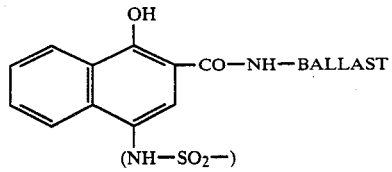

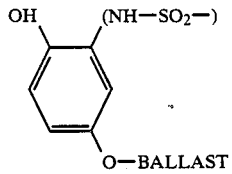

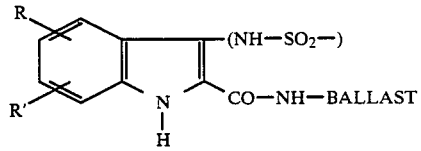

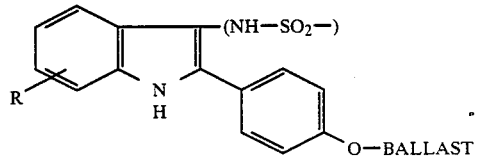

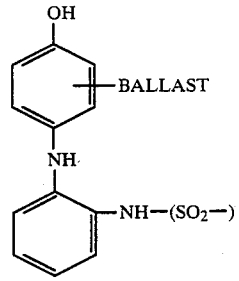

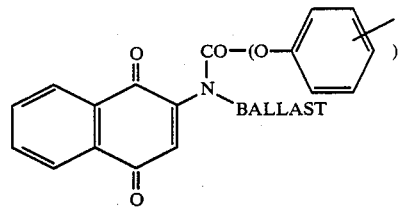

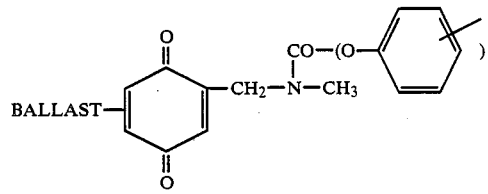

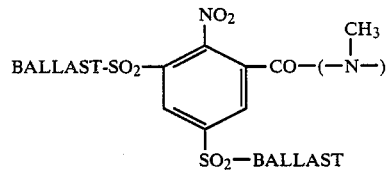

-continued

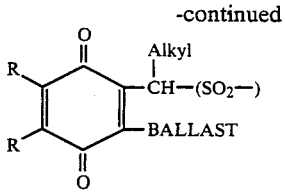

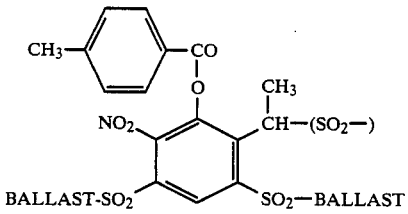

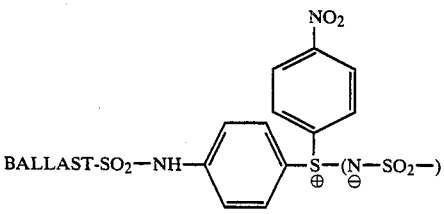

The groups in brackets are functional groups of the dye residue and are separated together with this residue from the remaining part of the carrier residue. The functional group may be a substituent which may exert a direct influence on the absorption and possibly also complex forming properties of the released dye but the functional group may also be separated from the chromophore of the dye by an intermediate or connecting link. Lastly, the functional group may be of some significance, optionally together with the intermediate link, in determining the diffusion and mordanting characteristics of the released dye. Alkylene and aryl groups, for example, are suitable connecting links.

The dye residues may in principle be residues from any classes of dyes, provided they are sufficiently diffusible to be capable of diffusing from the light-sensitive layer of the light-sensitive material into an image receptor layer. The dye residues may be provided with one or more alkali solubilizing groups for this purpose. Suitable alkali solubilizing groups include inter alia carboxyl groups, sulpho groups, sulphonamide groups and aromatic hydroxyl groups. Such alkali solubilizing groups may already be preformed in the dye releasing compounds used according to the invention or they may result from the release of the dye residue from the carrier residue which carries ballast groups. The following dyes are particularly suitable for the process according to the invention: Azo dyes, azomethine dyes, anthraquinone dyes, phthalocyanine dyes, indigoid dyes and triphenylmethane dyes, including dyes which have undergone or are capable of undergoing complex formation with metal ions.

The residues of dye precursors are residues of compounds which are converted into dyes in the course of the photographic process, in particular under conditions of heat development, either by oxidation or by coupling or by complex formation or by release of an auxochromic group in a chromophoric system, for example by saponification. Dye precursors in this sense may be leuco dyes or couplers or dyes which are converted into other dyes in the course of processing. The term "dye residues" will be used below to include dye precursor residues except where it is important to make a distinction between dye residues and residues of dye precursors.

Suitable dye releasing compounds are described, for example, in the following documents:

US-A-3 227 550, US-A-3 443 939, US-A-3 443 940, DE-A-1 930 215, DE-A-2 242 762, DE-A-2 402 900, DE-A-2 406 664, DE-A-2 505 248, DE-A-2 543 902, DE-A-2 613 005, DE-A-2 645 656, DE-A-2 809 716, DE-A-2 823 159, BE-A-861 241, EP-A-0 004 399, EP-A-0 004 400, DE-A-3 008 588, DE-A-3 014 669 and EP-A-0 038 092.

The dye releasing compounds may be in the form of oxidizable compounds or compounds capable of coupling in some embodiments of the heat development process according to the invention while in others they may be present as reducible dye releasing compounds. When conventional negative silver halide emulsions are used, the copy obtained from the original may be either a negative or a positive, depending on whether the dye has been released from the oxidized or the reduced form of the dye releasing compound. It is therefore possible to produce either positive or negative images as desired by suitable choice of the dye releasing systems.

Particularly suitable oxidizable dye releasing compounds have been described, for example, in DE-A-2 645 656.

When the dye releasing compound is oxidizable, it constitutes a reducing agent which is oxidised by the imagewise exposed silver halide, either directly or indirectly by means of electron transfer agents (ETA). An imagewise differentiation is then produced in the capacity to release the diffusible dye. If, on the other hand, the dye releasing compound is reducible, then it is suitably used in combination with a limited quantity of reducing agent present, a so-called electron donor compound or an electron donor precursor compound, which in that case is present in the same layer of binder as the dye releasing compound and the light-sensitive silver halide. The use of electron transfer agents may also be advantageous when reducible dye releasing compounds are used in combination with electron donor compounds.

For producing positive colour images from positive originals when negatively functioning silver halide emulsions are used it is suitable, for example, to use a recording material according to the invention which contains reducible dye releasing compounds containing a carrier residue corresponding to the following formula:

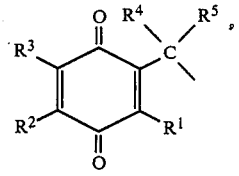

"Carquin"

wherein $R^1$ denotes alkyl or aryl;

$R^2$ denotes alkyl, aryl or a group which together with $R^3$ completes a condensed ring;

$R^3$ denotes hydrogen, alkyl, aryl, hydroxyl, halogen such as chlorine or bromine, amino, alkylamino, dialkylamino including cyclic amino groups (such as piperidino, morpholino), acylamino, alkylthio, alkoxy, aroxy, sulpho or a group which together with $R^2$ completes a condensed ring;

$R^4$ denotes alkyl;

$R^5$ denotes alkyl or, preferably, hydrogen, and at least one of the groups $R^1$ to $R^4$ contains a ballast residue.

The electron donor compound used in combination with a reducible dye releasing compound serves as reducing agent both for the silver halide and for the dye releasing compound. Since the silver halide and the dye releasing compound compete with each other for the oxidation of the electron donor compound and the silver halide is superior to the dye releasing compound in this reaction, the silver halide present determines, according to a previous imagewise exposure, those areas of the image within which the dye releasing compound will be converted into its reduced form by the electron donor compound.

Under the conditions of development, e.g. when the imagewise exposed colour photographic recording material is heated, the electron donor compound which is present in a limited quantity is oxidized to an extent depending on the amount of exposure which has previously taken place and is then no longer available for a reaction with the dye releasing compound. An imagewise distribution of unused electron donor compound is then obtained.

Compounds which have been described as electron donor compounds include, for example, non-diffusible or only slightly diffusible derivatives of hydroquinone, of benzisoxazolone, of p-aminophenol or of ascorbic acid (e.g. ascorbyl palmitate) (DE-A-2 809 716).

Other examples of electron donor compounds are known from DE-A-2 947 425, DE-A-3 006 268, DE-A-3 130 842, DE-A-3 144 037, DE-A-3 217 877 and EP-A-0 124 915 as well as Research Disclosure 24 305 (July 1984). It has been found that these electron donor compounds satisfy the requirements under the conditions of heat development and are therefore also suitable as electron donor compounds for the present invention. Particularly suitable are those electron donor compounds which are formed from the corresponding electron donor precursor compounds under the conditions of heat development in the layer, i.e. compounds which prior to development are only present in a masked form in the photographic material and therefore virtually inactive. These initially inactive electron donor compounds are converted into their active form under the conditions of heat development, for example by the removal of certain protective groups by hydrolysis. In the present context, these precursor compounds are also regarded as electron donor compounds.

In another embodiment, dye releasing compounds which are capable of taking part in a coupling reaction to release a diffusible dye may be used. This covers two possibilities; in the first case, the dye is formed by a chromogenic coupling reaction in which a diffusion inhibiting ballast group is removed from the coupling position. In the other case, the couplers are present in a non-diffusible form and carry a preformed dye residue as fugitive group in the coupling position, and this group is split off by the coupling reaction to become diffusible. Systems of this type are described, for example, in U.S. Pat. No. 3,227,550. The dye releasing compounds may also be polymeric couplers of the type which release dyes, as described, for example, in DE-A-3 422 455.

The above-mentioned essential components of the colour photographic recording material, namely the silver halide emulsion and the dye releasing compound optionally in combination with an electron donor compound, are dispersed in one and the same binder which may be either a hydrophobic or a hydrophilic binder although the latter is preferred. The binder used for the light-sensitive layer is preferably gelatine although this may be partly or completely replaced by other natural or synthetic binders. Examples of natural binders include alginic acid and its derivatives such as its salts, esters or amides, cellulose derivatives such as carboxymethylcellulose, alkyl celluloses such as hydroxyethylcellulose, starch and its derivatives and carrageenates. Polyvinyl alcohol, partially saponified polyvinyl acetate and polyvinyl pyrrolidone are examples of synthetic binders.

Examples of hydrophobic binders include polymers of polymerisable, ethylenically unsaturated monomers such as alkyl acrylates, alkyl methacrylates, styrene, vinyl chloride, vinyl acetate, acrylonitrile and acrylamides. Polyesters, polyurethane compounds and waxes may also be used. Polymers of this type may be used, for example, in a latex form.

For the production of monochrome colour images, the light-sensitive layer of binder contains, associated with the light-sensitive silver halide, one or more dye releasing compounds from which dyes of a particular colour are released. The colour finally obtained may be the result of mixing several dyes. It is thereby possible to produce black-and-white images by accurately mixing several dye releasing compounds of different colours. For the production of multicolour images, the colour photographic recording material of the present invention contains several, i.e. generally three associations of dye releasing compounds with silver halides sensitized to different regions of the spectrum, the absorption range of the dye released from the dye releasing compound preferably corresponding substantially to the region of spectral sensitivity of the associated silver halide. The various associations of dye releasing compounds with silver halide may be accommodated in different layers of binder of the colour photographic recording material, and these different layers of binders are preferably separated by layers of a water-permeable binder, e.g. gelatine, which may contain, for example, a scavenger for developer oxidation products and which mainly serve to separate the various associations from one another to counteract falsification of the colours. In such a case, the colour photographic recording material of the present invention contains, for example, one light-sensitive layer of binder in which the silver halide is predominantly sensitive to red as a result of spectral sensitization and which contains a cyan dye releasing compound, another light-sensitive layer of binder in which the silver halide has been rendered predominantly green sensitive by spectral sensitization and which contains a magenta dye releasing compound, and a third light-sensitive layer of binder in which the silver halide is predominantly sensitive to blue either due to its intrinsic sensitivity or as a result of spectral sensitization and which contains a yellow dye releasing compound.

In another embodiment of the present invention, each of the above-mentioned associations of light-sensitive silver halide and dye releasing compound is used in the form of a so-called complex coacervate.

A complex coacervate is a form of dispersion in which a mixture of the main components is enclosed in a common sheath of a hardened binder. Dispersions of this kind are known as packet emulsions and are obtained by complex coacervation.

Methods for the preparation of a packet emulsion in which a colour providing substance has been incorporated by complex coacervation are described, for example, in U.S. Pat. No. 3,276,869 and U.S. Pat. No. 3,396,026. The use of packet emulsions in heat developable recording materials is described, for example, in DE-A-3 510 685.

The use of packet emulsions according to the invention enables several emulsion components including the dye releasing compounds to be brought together in a single layer of binder without loss of the spectral association and therefore without falsification of colour. This is possible because the amount of dye released from the dye releasing compound present in the same coacervate particle (packet) as a silver halide is determined almost entirely by the extent of exposure of this silver halide particle. The use of packet emulsions thus enables a blue-sensitive, a green-sensitive and a red-sensitive silver halide emulsion and the spectrally associated dye releasing compounds to be accommodated in the same layer of binder without any serious risk of colour falsification.

In addition to the components already mentioned, the colour photographic recording material used according to the invention may contain other components and auxiliary substances. These additional substances may be present in a light-sensitive layer or in a layer which is insensitive to light.

These auxiliary substances may include, for example, auxiliary developers, which generally have a developing effect on exposed silver halide. In the present case, they mainly promote the reactions between the exposed silver halide and the reducing agent. When an oxidizable dye releasing compound is used, this may be identical with the reducing agent whereas a reducible dye releasing compound reacts with the reducing agent. Since these reactions consist mainly in a transfer of electrons, the auxiliary developers are also referred to as electron transfer agents (ETA).

The following are examples of suitable auxiliary developers: Hydroquinone, pyrocatechol, pyrogallol, hydroxylamine, ascorbic acid, 1-phenyl-3-pyrazolidone and its derivatives, e.g. 4-methyl-1-phenyl-3-pyrazolidone, 4,4-dimethyl-1-phenyl-3-pyrazolidone, 4-hydroxymethyl-4-methyl-1-phenyl-3pyrazolidone, 4-hydroxymethyl-4-methyl-1-tolyl-3-pyrazolidone and 4,4-dihydroxymethyl-1-phenyl-3-pyrazolidone. In some cases it is advantageous to use these compounds in a masked form with a protective group which can be split off under alkaline conditions. Since the auxiliary developers have a catalytic function, they need not be present in stoichiometric quantities. It is generally sufficient if they are present in the layer in quantities of up to ½ mol per mol of dye releasing compound. Their incorporation in the layer may be effected, for example, from solutions in water-soluble solvents or in the form of aqueous dispersions which have been obtained with the aid of oil formers.

Colour systems which undergo coupling reactions require colour developers. The conventional p-phenylenediamine developers or aminophenols may be used for this purpose. For reasons of stability it is advantageous to use the developer additives in a masked form from which the protective group is subsequently split off under the processing conditions.

In some embodiments of the process according to the invention, the light-sensitive element may contain an image receptor layer, especially if the light-insensitive sheet material which contains the precursor compound of the base does not already contain such an image receptor layer. The mordants used in such image receptor layers have already been mentioned. The image receptor layer may in this case be arranged above the light-sensitive layers or below them, between the light-sensitive layers and the layer support. In either case, the layer support is transparent and a light reflecting layer of binder which contains pigments and is permeable to alkalies is situated between the image receptor layer and the light-sensitive layers to serve as optical separation between the negative and the positive and as aesthetically pleasing image background for the transfer-red positive colour image.

Integral layer units of light-sensitive element and image receptor element may include stripping layers to separate the two layer elements.

The layer supports for the light-sensitive element and optionally for the image receptor element must be dimensionally stable at the temperature employed for processing. Conventional film supports or paper supports may be used, polyester materials being preferred.

The conventional hardeners used for photographic materials as well as rapid and instant hardeners may be used as hardeners for the light-sensitive element and for the image receptor element. Suitable hardeners are described, for example, in DE-A-2 439 551.

The light-sensitive element (first sheet material) is exposed imagewise, optionally through the layer support if the latter is transparent. For the photographic process, either the light-sensitive element or the light-insensitive sheet (second sheet material) or both is or are moistened with a sufficient quantity of water or of a liquid consisting predominantly of water, and the two materials are then placed together with their coated surfaces in contact and heated. The aqueous liquid may contain wetting agents and/or water softeners. After development and transfer of the colour image into the image receptor layer have taken place, the two sheet materials are separated and the transferred colour image is then visible either as an image viewed by reflected light or as a diapositive, depending on the composition of the layers.

EXAMPLE 1

A light-sensitive element of a heat developable recording material was prepared by application of the layers described below to a transparent layer support of polyethylene terephthalate. The quantities given are based in each case on 1 $m^2$.

Layer 1

A layer containing a green-sensitized, gold/sulphur-ripened silver halide emulsion of 0.6 g of $AgNO_3$ (4 mol-% of AgCl, 89 mol-% AgBr, 7 mol-% AgI, average grain diameter 0.3 μm) and 0.4 g of dye releasing compound M-1 emulsified in 0.20 g of diethyllauramide, 0.07 g of compound SC and 1.2 g of gelatine.

Layer 2

A layer containing 0.035 g of 4,4-dimethyl-1-phenyl-3-pyrazolidone, 0.3 g of compound SC and 1.4 g of gelatine.

Layer 3

A protective layer containing 0.5 g of gelatine. The hardener was applied together with this protective layer.

The substances according to the invention and the comparison substances were then tested by using the SH-compounds in Layer 1 and the NH- and STP-compounds in Layer 2, either alone or together, as shown in Table 1. Samples 1 to 29 were obtained. Samples 1 to 19 and 26 served for comparison and Samples 20 to 25 and 27 to 29 contained the substance combinations according to the invention.

An image receptor element for the heat developable recording material was prepared by applying the following layers in succession to a layer support of polyethylene coated paper. The quantities indicated are based in each case on 1 $m^2$.

Layer 1

A layer containing 2 g of guanidinium carbonate, 0.007 g of compound WA and 3 g of gelatine.

Layer 2

A mordant layer containing 2 g of polyurethane mordant obtained from 4,4'-diphenylmethane diisocyanate and N-ethyldiethanolamine quaternized with epichlorohydrin according to DE-A-2 631 521, Example 1, with 0.035 g of compound WA and 2 g of gelatine.

Layer 3

An interlayer containing 1 g of gelatine.

Layer 4

A hardening layer containing 0.25 g of formalin and 0.85 g of gelatine.

Processing was carried out as follows: the recording material which had been exposed through a step wedge was immersed in water for 4 seconds and then heated to 90° C. together with the image receptor element with their coated surface in contact for 20 seconds. The two elements were then separated and a magenta negative image of the exposure original was found on the image receptor element.

The stability of the samples in storage was tested. For this purpose, the samples were developed in the fresh state (=Test 1), after storage in a heating cupboard (=Test 2) and after storage in a tropical cupboard (=Test 3). The heating cupboard conditions were 3 days' storage at 60° C. and the tropical cupboard conditions were 3 days' storage at 35° C. and 90% relative humidity.

The results of development of samples 1 to 29 are summarized in Table 1. The minimum and maximum densities (behind green filters) and the relative sensitivity were measured after tests 1, 2 and 3. As may be seen from Table 1, the comparison films which do not contain the substance combinations according to the invention in some cases have a high degree of fogging even in the fresh state and in particular they show severe loss of sensitivity after the storage test. The substance combination used, on the other hand, showed not only good $D_{min}/D_{max}$ relations but especially also a marked improvement in storage stability with respect to the constancy of sensitivity.

TABLE 1

| Sample | SH Compound | mg/$m^2$ | NH Compound | mg/$m^2$ | STP Compound | mg/$m^2$ | Test | E logI · t | $D_{min}/D_{max}$ | Remarks |
|---|---|---|---|---|---|---|---|---|---|---|
| 1 | — | — | — | — | — | — | 1 | — | 2.29/2.29 | Comparison |
| 2 | V-SH | 2.8 | — | — | — | — | 1 | — | 2.05/2.26 | " |
| 3 | SH-14 | 6.2 | — | — | — | — | 1 | — | 2.25/2.25 | " |
| 4 | SH-1 | 3.6 | — | — | — | — | 1 | — | 2.20/2.25 | " |
| 5 | SH-15 | 3.5 | — | — | — | — | 1 | — | 2.24/2.24 | " |
| 6 | SH-6 | 3.2 | — | — | — | — | 1 | — | 1.60/2.18 | " |
| 7 | SH-17 | 4.5 | — | — | — | — | 1 | — | 2.18/2.18 | " |
| 8 | SH-18 | 4.5 | — | — | — | — | 1 | — | 2.18/2.19 | " |
| 9 | SH-9 | 5 | — | — | — | — | 1 | — | 2.16/2.16 | " |
| 10 | SH-9 | 25 | — | — | — | — | 1 | — | 2.14/2.14 | " |
| 11 | SH-9 | 50 | — | — | — | — | 1 | — | 2.20/2.20 | " |
| 12 | — | — | NH-2 | 58 | — | — | 1 | — | 1.70/2.32 | " |
| 13 | — | — | NH-2 | 100 | — | — | 1 | — | 0.59/2.24 | " |
| 14 | — | — | NH-2 | 150 | — | — | 1 | 2.24 | 0.18/2.31 | Comparison |
| | | | | | | | 2 | 2.00 | 0.18/1.78 | " |
| | | | | | | | 3 | 1.66 | 0.17/1.54 | " |
| 15 | — | — | NH-2 | 200 | — | — | 1 | 2.27 | 0.18/2.31 | " |
| | | | | | | | 2 | 1.84 | 0.15/1.68 | " |
| | | | | | | | 3 | 1.28 | 0.13/2.01 | " |
| 16 | — | — | — | — | STP-1 | 100 | 1 | 2.35 | 0.46/2.22 | " |
| 17 | — | — | — | — | STP-1 | 150 | 1 | 2.28 | 0.34/2.21 | " |
| 18 | — | — | — | — | STP-1 | 200 | 1 | 2.19 | 0.26/2.23 | " |
| 19 | — | — | NH-2 | 58 | STP-1 | 100 | 1 | 2.19 | 0.09/2.25 | Invention |
| | | | | | | | 2 | 1.66 | 0.14/1.74 | " |
| | | | | | | | 3 | 1.67 | 0.09/2.22 | " |
| 20 | SH-9 | 58 | NH-2 | 58 | STP-1 | 100 | 1 | 2.06 | 0.09/2.19 | Invention |
| | | | | | | | 2 | 1.79 | 0.13/1.84 | " |
| | | | | | | | 3 | 1.95 | 0.09/2.25 | " |
| 21 | SH-14 | 6.2 | NH-2 | 58 | STP-1 | 100 | 1 | 2.06 | 0.13/2.19 | Invention |
| | | | | | | | 2 | 2.03 | 0.14/1.78 | |
| | | | | | | | 3 | 2.22 | 0.13/2.22 | |
| 22 | SH-1 | 3.6 | NH-2 | 58 | STP-1 | 100 | 1 | 2.00 | 0.11/2.24 | Invention |
| | | | | | | | 2 | 1.75 | 0.14/1.64 | |
| | | | | | | | 3 | 1.89 | 0.12/2.21 | |
| 23 | SH-15 | 3.5 | NH-2 | 58 | STP-1 | 100 | 1 | 1.99 | 0.14/2.18 | Invention |
| | | | | | | | 2 | 1.86 | 0.14/1.72 | |
| | | | | | | | 3 | 1.96 | 0.16/2.23 | |
| 24 | SH-6 | 3.2 | NH-2 | 58 | STP-1 | 100 | 1 | 2.19 | 0.14/2.26 | Invention |
| | | | | | | | 2 | 2.09 | 0.14/2.02 | " |

TABLE 1-continued

| Sample | SH Compound | mg/m² | NH Compound | mg/m² | STP Compound | mg/m² | Test | E logI · t | $D_{min}/D_{max}$ | Remarks |
|---|---|---|---|---|---|---|---|---|---|---|
| | | | | | | | 3 | 1.92 | 0.17/2.18 | " |
| 25 | SH-17 | 2.3 | NH-2 | 58 | STP-1 | 100 | 1 | 2.29 | 0.11/2.32 | Invention |
| | | | | | | | 2 | 1.99 | 0.13/2.03 | |
| | | | | | | | 3 | 2.00 | 0.19/2.19 | |
| 26 | V-SH | 2.8 | NH-2 | 58 | STP-1 | 100 | 1 | 2.06 | 0.08/2.29 | Comparison |
| | | | | | | | 2 | 1.48 | 0.12/1.71 | |
| | | | | | | | 3 | — | 0.07/0.13 | |
| 27 | SH-9 | 5 | NH-2 | 58 | STP-1 | 148 | 1 | 2.15 | 0.10/2.29 | Invention |
| | | | | | | | 2 | 1.92 | 0.13/2.05 | |
| | | | | | | | 3 | 1.84 | 0.08/2.17 | |
| 28 | SH-9 | 58 | NH-3 | 37 | STP-1 | 100 | 1 | 2.21 | 0.13/2.21 | Invention |
| | | | | | | | 2 | 1.76 | 0.13/1.89 | |
| | | | | | | | 3 | 1.86 | 0.09/2.16 | |
| 29 | SH-9 | 58 | NH-1 | 67 | STP-1 | 100 | 1 | 2.24 | 0.20/2.18 | Invention |
| | | | | | | | 2 | 1.83 | 0.14/1.84 | |
| | | | | | | | 3 | 2.11 | 0.11/2.14 | |

EXAMPLE 2

Layer 1

A layer containing 0.035 g of 4,4-dimethyl-1-phenyl-3-pyrazolidone, 0.3 g of Compound SC, 0.1 g of Compound ST-P-1 according to the invention and 1.4 g of gelatine.

Layer 2

A layer containing a blue-sensitized, ripened silver halide emulsion of 0.5 g of $AgNO_3$ (20 mol-% AgCl, 80 mol-% AgBr, average grain diameter 0.8 μm), 0.35 g of dye releasing compound Y-1, 0.06 g of Compound SC and the compounds according to the invention in the following composition: 0.001 g of Compound SH-14, 0.05 g of Compound NH-2 and 0.1 g of Compound STP-1 and 1.6 g of gelatine.

Layer 3

A protective layer containing 0.5 g of gelatine. The hardener was applied together with this layer.

The material prepared as described above was labelled Sample 30. It was processed as described in Example 1 but with a contact time of 30 seconds. The results of development before storage (=Test 1), after storage in the heating cupboard (=Test 2) and after storage in the tropical cupboard (=Test 3) are summarized in Table 2. These results show that a high degree of stability in storage is achieved by the addition of the substance combination according to the invention. It is clear from this example that the additives according to the invention are also effective in another type of emulsion.

TABLE 2

| Sample | Test | Log I.t | $D_{min}$ | $D_{max}$ |
|---|---|---|---|---|
| 30 | 1 | 2.59 | 0.12 | 1.91 |
| | 2 | 2.25 | 0.11 | 1.93 |
| | 3 | 2.53 | 0.11 | 1.90 |

Annexe of Formulae, Example 1-2

Dye releasing compound Y-1

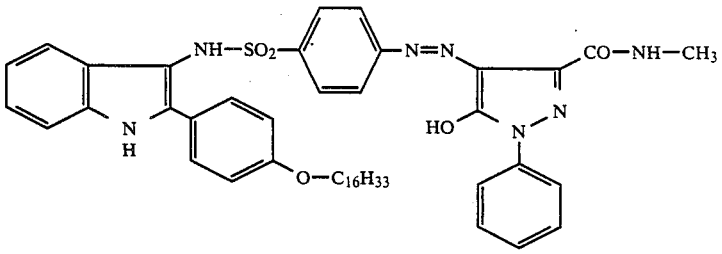

Dye releasing compound M-1

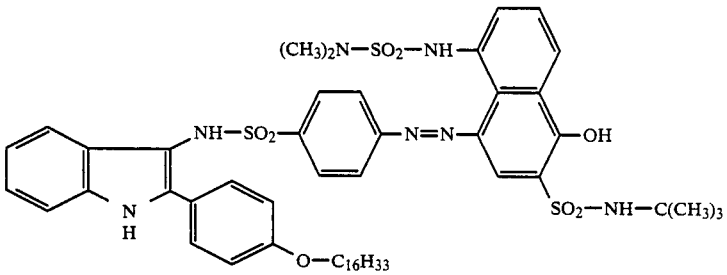

TABLE 2-continued

Compound SC

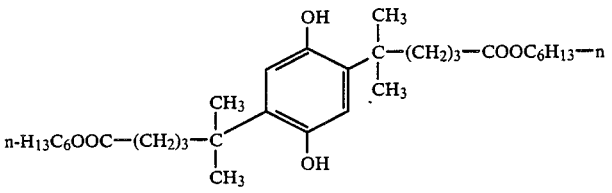

Compound WA

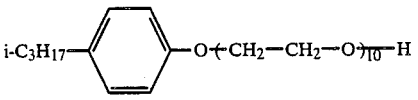

Comparison substance V—SH

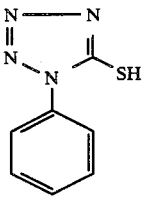

We claim:

1. Process for the production of colour images by the photographic dye diffusion process in which a first light-sensitive sheet material is imagewise exposed, at least one of said first light-sensitive sheet material and a second light-insensitive sheet material is moistened with an aqueous liquid and the two sheet materials are together heated to 50°–100° C. with their coated surfaces in contact and then separated, said first sheet material containing, on a layer support, at least one light-sensitive silver halide emulsion layer and at least one non-diffusible colour providing compound which is capable of being decomposed imagewise in the process of development to release a diffusible dye and said second sheet material containing a salt of a strong organic base and a weak acid, wherein said first sheet material contains a combination of compounds corresponding to the following formulae I and II:

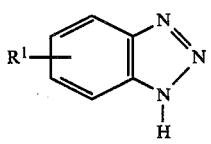

(I)

wherein $R^1$ denotes hydrogen, alkyl with up to 6 carbon atoms, halogen, hydroxy, alkoxy or substituents which together form a condensed benzene ring, and

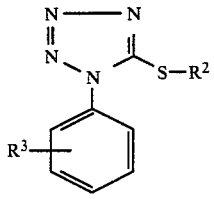

(II)

wherein $R^2$ denotes a group which can be split off in the process of development of the material and $R^3$ denotes hydrogen, halogen, alkyl with up to 4 carbon atoms, alkoxy, carboxy, carbalkoxy, carbonamido or sulphonamido.

2. Process as claimed in claim 1, wherein the first, light-sensitive sheet material in addition contains at least one compound corresponding to one of the following formulae III or IV:

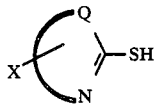

(III)

wherein

Q denotes the group required for completing a heterocyclic group containing a 5- or 6-membered heterocyclic ring, X denotes a carboxylic or sulphonic acid group or a residue containing a carboxylic or sulphonic acid group; and

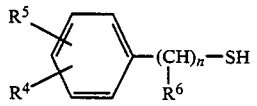

(IV)

wherein $R^4$ denotes hydrogen, alkyl with up to 18 carbon atoms, alkoxy or halogen, $R^5$ denotes hydrogen or an alkyl group with up to 18 carbon atoms, $R^6$ denotes hydrogen or an alkyl group with up to 3 carbon atoms, and n denotes 0, 1 or 2.

3. Process as claimed in claim 1, wherein the second, light-insensitive sheet material contains a mordant for fixing the dye which has been release imagewise.

4. Process as claimed in claim 1, wherein the second, light-insensitive sheet material contains a guanidinium salt.

* * * * *